US009659463B2

(12) United States Patent
Carter et al.

(10) Patent No.: US 9,659,463 B2
(45) Date of Patent: May 23, 2017

(54) WAGERING GAME WITH REEL-SWAP FEATURE

(71) Applicant: WMS Gaming Inc., Waukegan, IL (US)

(72) Inventors: Elizabeth A. Carter, Chicago, IL (US); Joel R. Jaffe, Glenview, IL (US); Pamela S. Smith, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 286 days.

(21) Appl. No.: 14/687,741

(22) Filed: Apr. 15, 2015

(65) Prior Publication Data

US 2015/0302685 A1 Oct. 22, 2015

Related U.S. Application Data

(60) Provisional application No. 61/980,180, filed on Apr. 16, 2014.

(51) Int. Cl.
*G07F 17/34* (2006.01)
*G07F 17/32* (2006.01)

(52) U.S. Cl.
CPC ..... *G07F 17/34* (2013.01); *G07F 17/3262* (2013.01)

(58) Field of Classification Search
USPC ..... 463/20, 22
See application file for complete search history.

(56) References Cited

U.S. PATENT DOCUMENTS

| | | | |
|---|---|---|---|
| 6,805,632 | B2 | 10/2004 | Suda |
| 6,855,054 | B2 | 2/2005 | White |
| 7,077,745 | B2 | 7/2006 | Gomez |
| 7,371,168 | B2 | 5/2008 | Bilyeu |
| 7,371,170 | B2 | 5/2008 | Cregan |
| 7,578,737 | B2 | 8/2009 | Cregan |
| 7,578,738 | B2 | 8/2009 | Cregan |
| 7,591,724 | B2 | 9/2009 | Baerlocher |
| 7,625,281 | B2 | 12/2009 | Bilyeu |
| 7,695,365 | B2 | 4/2010 | Casey |
| 7,704,141 | B1 | 4/2010 | Marks |
| 7,785,188 | B2 | 8/2010 | Cannon |
| 7,803,045 | B2 | 9/2010 | Wadleigh |
| 7,950,994 | B2 | 5/2011 | Berman |
| 8,162,741 | B2 | 4/2012 | Wadleigh |
| 8,419,519 | B2 | 4/2013 | Aoki |

(Continued)

FOREIGN PATENT DOCUMENTS

| | | | |
|---|---|---|---|
| GB | 1359852 | A | 7/1974 |
| GB | 1568522 | A | 5/1980 |

(Continued)

*Primary Examiner* — Pierre E Elisca
(74) *Attorney, Agent, or Firm* — Nixon Peabody LLP

(57) ABSTRACT

A gaming system includes a gaming machine, a random element generator, and game-logic circuitry. An initial outcome is displayed in the form of a plurality of symbols arranged in a primary array and a secondary array, the primary array including a plurality of primary reels and the secondary array including a secondary reel. In response to the plurality of symbols including a trigger symbol, one of the primary reels is substituted with the secondary reel to form a modified primary array. A modified outcome is determined based on the modified primary array.

20 Claims, 11 Drawing Sheets

(56) References Cited

U.S. PATENT DOCUMENTS

| | | | | |
|---|---|---|---|---|
| 8,529,333 | B2 | 9/2013 | Berman | |
| 8,585,487 | B2 | 11/2013 | Rodgers | |
| 8,602,871 | B2 | 12/2013 | Wadleigh | |
| 9,520,022 | B2 * | 12/2016 | Gobe | G07F 17/3213 |
| 2002/0175466 | A1 | 11/2002 | Loose | |
| 2004/0033827 | A1 | 2/2004 | Gilmore | |
| 2015/0011297 | A1 * | 1/2015 | Chan | G07F 17/34 463/20 |
| 2015/0262454 | A1 * | 9/2015 | Hornik | G07F 17/32 463/21 |
| 2016/0155303 | A1 * | 6/2016 | Aoki | G07F 17/3244 463/16 |
| 2016/0217646 | A1 * | 7/2016 | Hornik | G07F 17/3213 |

FOREIGN PATENT DOCUMENTS

| | | | |
|---|---|---|---|
| GB | 2062923 | A | 5/1981 |
| GB | 2097160 | A | 10/1982 |

* cited by examiner

WAGERING GAME WITH REEL-SWAP FEATURE

CROSS-REFERENCE TO RELATED APPLICATIONS

This application claims the benefit of and priority to U.S. Provisional Patent Application No. 61/980,180 titled "Wagering Game With Reel-Swap Feature" and filed on Apr. 16, 2014, which is incorporated herein by reference in its respective entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a reel array in which reels are substituted in accordance with a triggering condition.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a gaming system includes a gaming machine primarily dedicated to playing at least one casino wagering game. The gaming machine includes a gaming cabinet, an electronic display device, and an electronic input device. The cabinet is constructed to house components associated with the casino wagering game. The electronic display device and the electronic input device are coupled to the gaming cabinet, and the electronic input device is configured to receive a physical input from a player to initiate the casino wagering game and transform the input into an electronic data signal. The gaming system further includes a random element generator configured to generate one or more random elements, and game-logic circuitry configured to initiate the casino wagering game in response to the electronic data signal from the electronic input device of the gaming machine. The game-logic circuitry is further configured to determine an initial outcome of the casino wagering game based, at least in part, on the one or more random elements, and to direct the electronic display device of the gaming machine to display the initial outcome. The initial outcome is displayed in the form of a plurality of symbols in a primary array and a secondary array, the primary array including a plurality of primary reels and the secondary array including a secondary reel. In response to the plurality of symbols including a trigger symbol, one of the primary reels is substituted with the secondary reel to form a modified primary array, and a modified outcome is determined based on the modified primary array. An award is awarded in response to the initial outcome or the modified outcome meeting a predetermined award criterion.

According to another aspect of the invention, a method is directed to operating a gaming system, which includes a random element generator, game-logic circuitry, and a gaming machine. The gaming machine is primarily dedicated to playing at least one casino wagering game, and includes a gaming cabinet, an electronic display device, and an electronic input device. The cabinet is constructed to house components associated with the casino wagering game, and the electronic display device and the electronic input device are coupled to the gaming cabinet. The method includes generating one or more random elements with the random element generator, and receiving, responsive to a physical input to the electronic input device of the gaming machine, a wager input to initiate the casino wagering game. The method further include determining, by the game-logic circuitry, an initial outcome of the casino wagering game based, at least in part, on the one or more random elements, and displaying the initial outcome on the electronic display device of the respective gaming machine. The initial outcome is displayed in the form of a plurality of symbols in a primary array and a secondary array, the primary array including a plurality of primary reels and the secondary array including a secondary reel. In response to the plurality of symbols including a trigger symbol, one of the primary reels is substituted with the secondary reel to form a modified primary array, and a modified outcome is determined, by the game-logic circuitry, based on the modified primary array. An award is awarded, by the game-logic circuitry, in response to the initial outcome or the modified outcome meeting a predetermined award criterion.

According to yet another aspect of the invention, a casino gaming machine is primarily dedicated to playing at least one casino wagering game and includes a gaming cabinet for housing components associated with the casino wagering game. The casino gaming machine further includes an electronic display device coupled to the gaming cabinet, and an electronic input device coupled to the gaming cabinet. The electronic input device is configured to receive a physical input from a player to initiate the casino wagering game and transform the input into an electronic data signal. The casino gaming machine also includes game-logic circuitry disposed within the gaming cabinet and including a random element generator, the random element generator being configured to generate one or more random elements. The game-logic circuitry is configured to initiate the casino wagering game in response to the electronic data signal from the electronic input device, to determine an initial outcome of the casino wagering game based, at least in part, on the one or more random elements, and to direct the electronic display device to display the initial outcome in the form of a first plurality of symbols in a primary array and a secondary array. The primary array includes a plurality of primary reels and the secondary array includes a secondary reel. In response to a first triggering event, a first primary reel of the primary reels is substituted with the secondary reel to form a first modified primary array and a first modified secondary array. A first modified outcome is determined based on the first modified primary array, and the electronic display device is directed to display a second plurality of symbols in the first modified primary array and the first modified secondary array reel. While maintaining the secondary reel in the first modified primary array, a second modified outcome is determined based on the second plurality of symbols in the first modified primary array and the first modified secondary array. An award is awarded in response to any of the initial outcome, the first modified outcome, or the second modified outcome meeting a predetermined award criterion.

Additional aspects of the invention will be apparent to those of ordinary skill in the art in view of the detailed description of various embodiments, which is made with reference to the drawings, a brief description of which is provided below.

Figure 1:
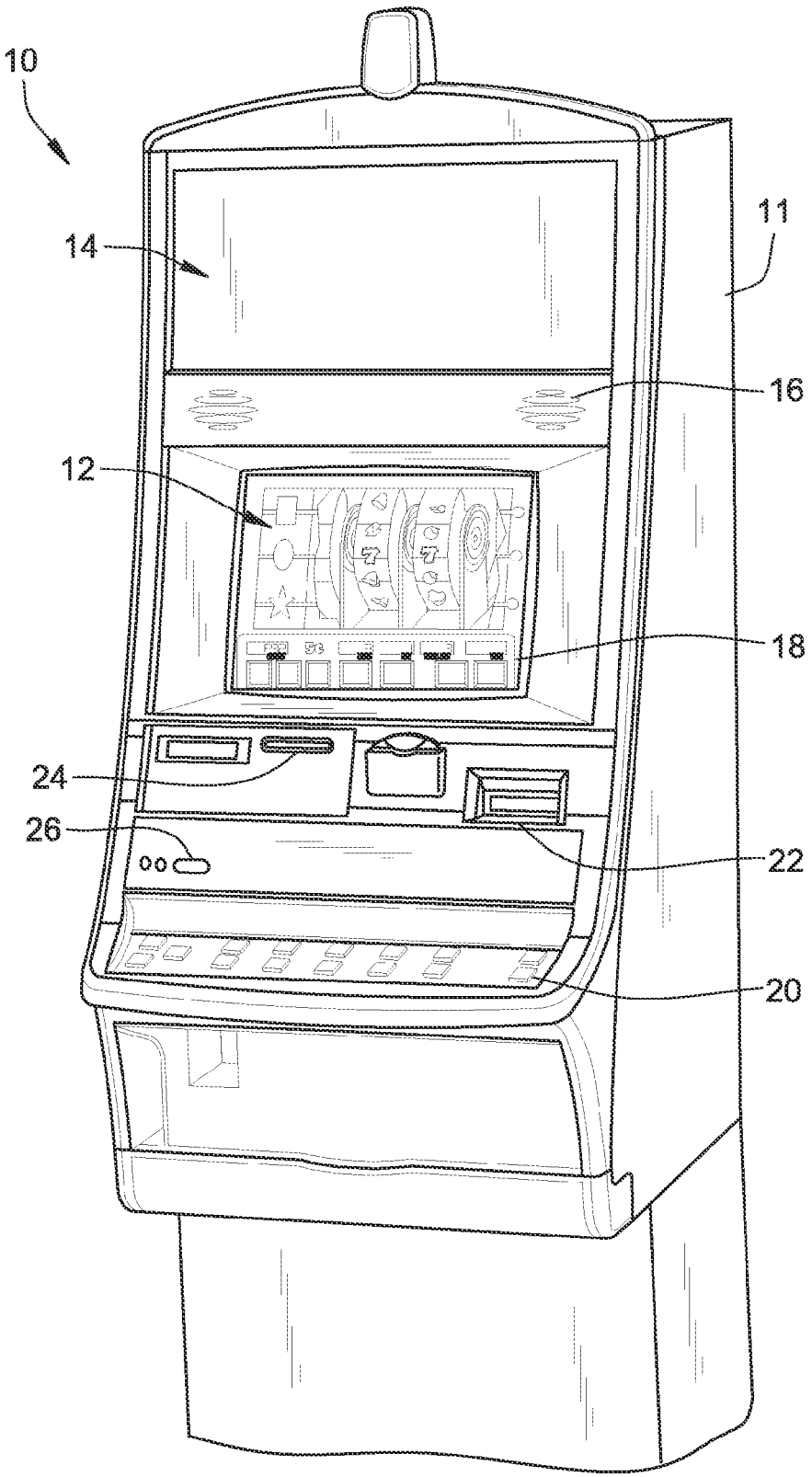
FIG. 1 (PRIOR ART)
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those used in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in conducting wagering games, or may include non-dedicated devices, such as mobile phones, personal digital assistants, personal computers, etc. Exemplary types of gaming machines are disclosed in U.S. Pat. No. 6,517,433 and Patent Application Publication Nos. US2010/0069160 and US2010/0234099, which are incorporated herein by reference in their entireties.

The gaming machine 10 illustrated in FIG. 1 comprises a cabinet 11 that may house various input devices, output devices, and input/output devices. By way of example, the gaming machine 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

Input devices, such as the touch screen 18, buttons 20, a mouse, a joystick, a gesture-sensing device, a voice-recognition device, and a virtual-input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a game-logic circuitry for processing. The electronic data signals are selected from a group consisting essentially of an electrical current, an electrical voltage, an electrical charge, an optical signal, an optical element, a magnetic signal, and a magnetic element.

Figure 2:
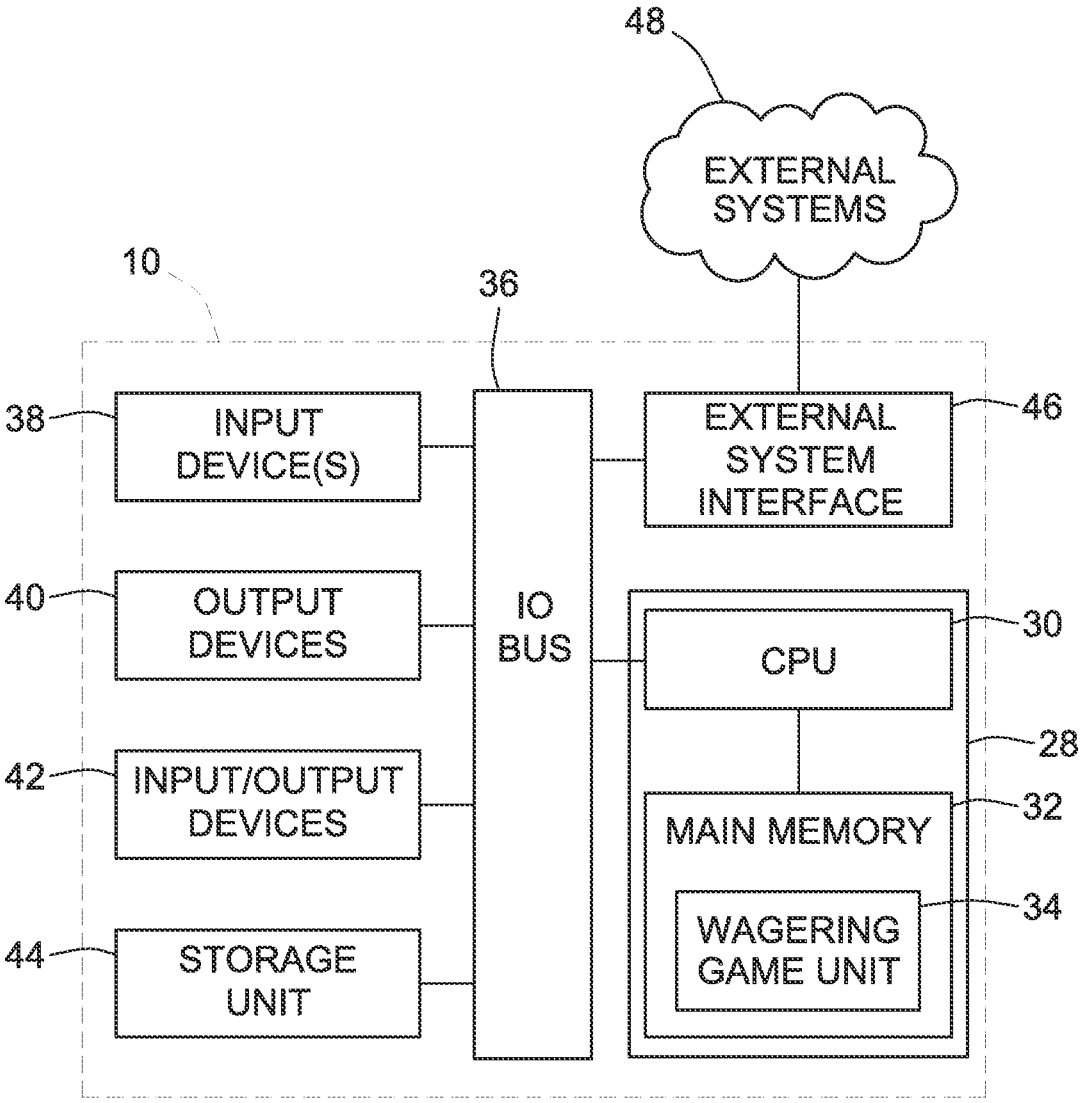
FIG. 2 (PRIOR ART)
FIG. 2 is a schematic view of a gaming system according to an embodiment of the present invention.

Turning now to FIG. 2, there is shown a block diagram of the gaming-machine architecture. The gaming machine 10 includes game-logic circuitry 28 having a central processing unit (CPU) 30 connected to a main memory 32. The CPU 30 may include any suitable processor(s), such as those made by Intel and AMD. By way of example, the CPU 30 may include a plurality of microprocessors including a master processor, a slave processor, and a secondary or parallel processor. Game-logic circuitry 28, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 28, and more specifically the CPU 30, comprises one or more controllers or processors and such one or more controllers or processors need not be disposed proximal to one another and may be located in different devices or in different locations. The game-logic circuitry 28, and more specifically the main memory 32, comprises one or more memory devices which need not be disposed proximal to one another and may be located in different devices or in different locations. The game-logic circuitry 28 is operable to execute all of the various gaming methods and other processes disclosed herein. The main memory 32 includes a wagering-game unit 34. In one embodiment, the wagering-game unit 34 may cause wagering games to be presented, such as video poker, video black jack, video slots, video lottery, etc., in whole or part.

The game-logic circuitry 28 is also connected to an input/output (I/O) bus 36, which can include any suitable bus technologies, such as an AGTL+frontside bus and a PCI backside bus. The I/O bus 36 is connected to various input devices 38, output devices 40, and input/output devices 42 such as those discussed above in connection with FIG. 1. The I/O bus 36 is also connected to a storage unit 44 and an external-system interface 46, which may be connected to external system(s) 48 (e.g., wagering-game networks).

The external system 48 includes, in various aspects, a gaming network, other gaming machines or terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external-system interface 46 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 48 such that the gaming machine 10 operates as a thin, thick, or intermediate client. The game-logic circuitry 28—whether located within ("thick client"), external to ("thin client"), or distributed both within and external to ("intermediate client") the gaming machine 10—is utilized to provide a wagering game on the gaming machine 10. In general, the main memory 32 (comprising one or more memory devices) stores programming for a random element generator ("RNG"), game-outcome logic, and game assets (e.g., art, sound, etc.). When a wagering-game instance is executed, the CPU 30 (comprising one or more processors or controllers) executes the RNG programming to generate one or more pseudo-random numbers. The pseudo-random numbers are utilized by the CPU 30 when executing the game-outcome logic to determine a resultant outcome for that instance of the wagering game. The resultant outcome is then presented to a player of the gaming machine 10 by accessing the associated game assets, required for the resultant outcome, from the main memory 32. The CPU 30 causes the game assets to be presented to the player as outputs from the gaming machine 10 (e.g., audio and video presentations).

The gaming machine 10 may include additional peripheral devices or more than one of each component shown in FIG. 2. Any component of the gaming-machine architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
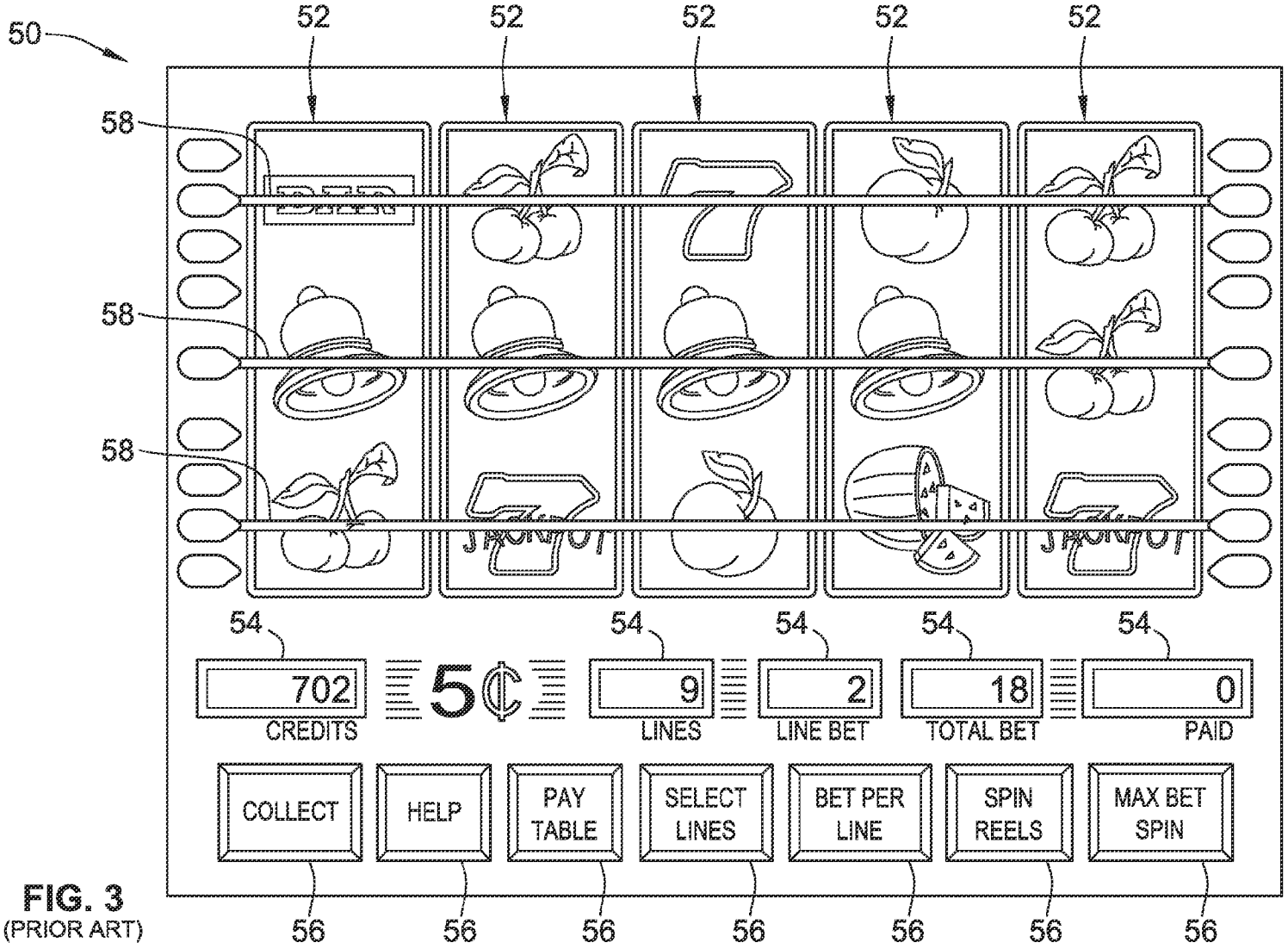
FIG. 3 (PRIOR ART)
FIG. 3 is an image of an exemplary basic-game screen of a wagering game displayed on a gaming machine, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The game-logic circuitry 28 operates to execute a wagering-game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus trigger symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 12 or secondary display 14) through the display of information such as, but not limited to, text, graphics, static images, moving images, etc., or any combination thereof. In accord with the method of conducting the wagering game, the game-logic circuitry 28 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 28 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 30 causes the recording of a digital representation of the wager in one or more storage media (e.g., storage unit 44), the CPU 30, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU 30 (e.g., the wager in the present example). As another example, the CPU 30 further, in accord with the execution of the stored instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 28 to determine the outcome of the wagering-game instance. In at least some aspects, the game-logic circuitry is configured to determine an outcome of the wagering-game instance at least partially in response to the random parameter.

Figure 4:
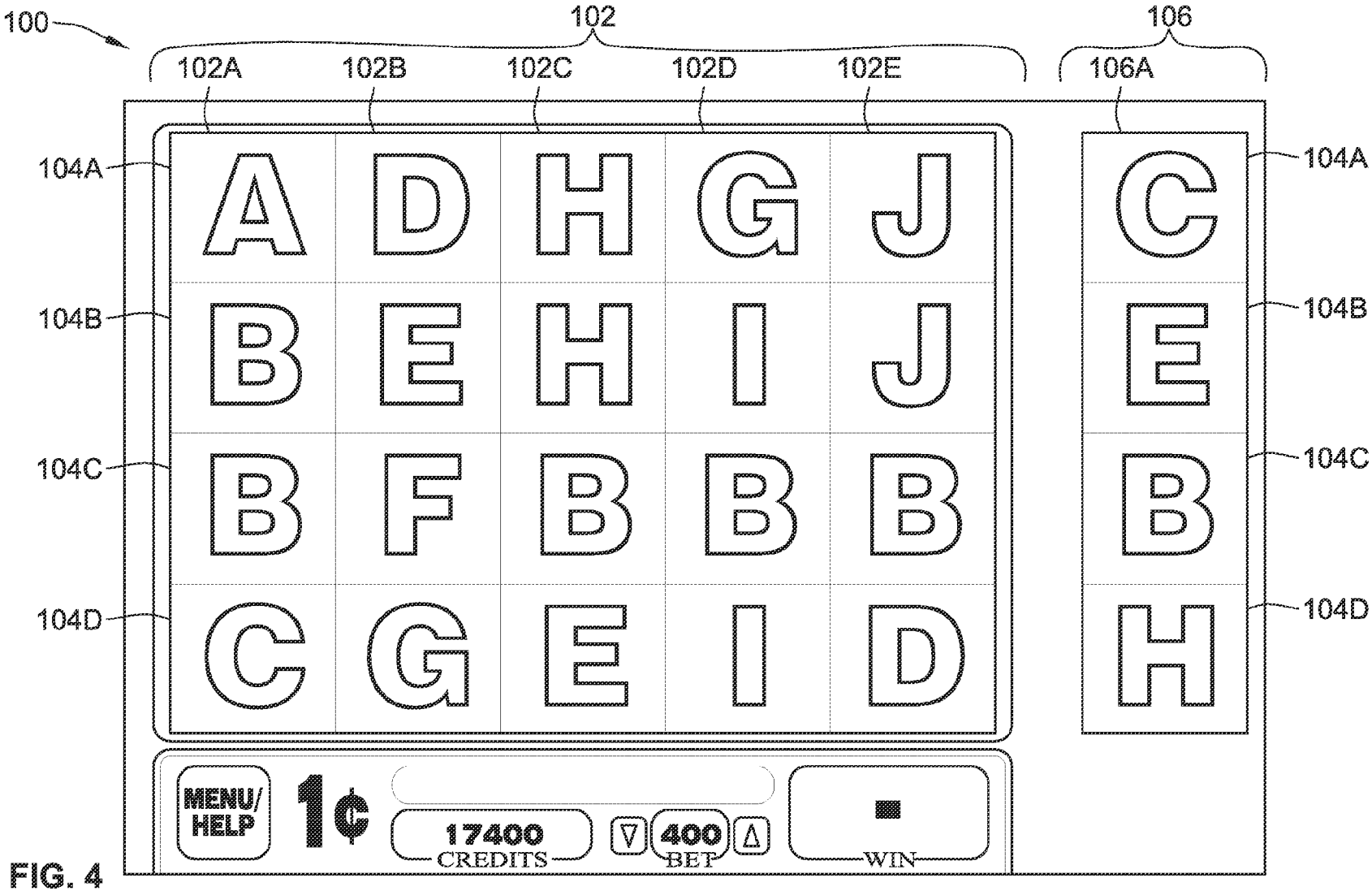
FIG. 4 illustrates an image of a wagering game having a primary array with primary reels and a secondary array with a secondary reel.

Referring now to FIG. 4, an illustrated image of a wagering game screen 100 is adapted to be displayed on the main display area 12 or the secondary display area 14. The game screen 100 portrays a primary array 102 arranged in the form of a plurality of primary symbol-bearing reels, which include a first primary reel 102A, a second primary reel 102B, a third primary reel 102C, a fourth primary reel 102D, and a fifth primary reel 102E. In this example, each primary reel 102A-102E has four displayed positions, including a top position 104A, a top-center position 104B, a bottom-center position 104C, and a bottom position 104D (as viewed from top to bottom). Thus, the primary array 102 is a 5×4 array with five columns (i.e., five primary reels 102A-102E) and four rows (i.e., four positions 104A-104D). In alternative embodiments, the primary array 102 includes any number of columns and rows.

The game screen 100 further portrays a secondary array 106 arranged in the form of a secondary reel 106A, with four displayed positions 104A-104D. The secondary array 106 is separate from the primary array 102, being excluded from outcome evaluations of the primary array 102. Both arrays 102, 106 are displayed on the game screen 100, as illustrated in FIG. 4 in an adjacent configuration, or in various alternative configurations (e.g., the secondary array 106 is displayed above, below, or to the left of the primary array 102). In alternative embodiments, the secondary array 106 includes any number of columns and rows.

The secondary array 106 is displayed such that there is a visual distinction between the primary array 102 and the secondary array 106. For example, a separation between the location of the two arrays 102, 106 (as shown in FIG. 4) is the visual distinction that distinguishes the two array 102, 106. In another example, the arrays 102, 106 are each highlighted with a respective color, e.g., the primary array 102 is highlighted with blue and the secondary array 106 is highlighted with yellow. In yet another example, the primary array 102 is displayed prominently with bold, colorful features, while the secondary array 106 is displayed, at least temporarily, in subdued, grayed-out features. Regardless of the selected visual distinction, the representation of the two array 102, 106 is such that a player is able to discern that two distinct arrays are included in the wagering game.

Each array position 104A-104D of the primary and secondary arrays 102, 106 is populated, upon spinning and stopping of the reels 102A-102E, 106A with a respective symbol. As such, the symbols are randomly selected and arranged in the primary and secondary arrays 102, 106 to display an initial outcome of the wagering game. According to one example, the spinning of all the reels 102A-102E, 106A occurs during each play of the wagering game. In other words, the reels of both arrays 102, 106 are spun, regardless of whether the secondary reel 106A is evaluated. According to this example, the secondary reel 106A is activated and spun during each play, even if the secondary reel 106A is evaluated only for some of the plays, i.e., when a triggering event occurs (as described below).

According to another example, the spinning of the secondary reel 106A occurs only during some of the plays in which the primary reels 102A-102E are spun. As such, the secondary reel 106A of this example is only activated for some, but not all, of the plays in which the primary reels 102A-102E are activated. By way of example, the primary reels 102A-102E are activated in response to receiving a wager input. The determination to activate the secondary reel 106A includes a random determination or a manual player determination, or can be in accordance with a predetermined rule (e.g., if a certain minimum amount has been wagered).

Figure 5:
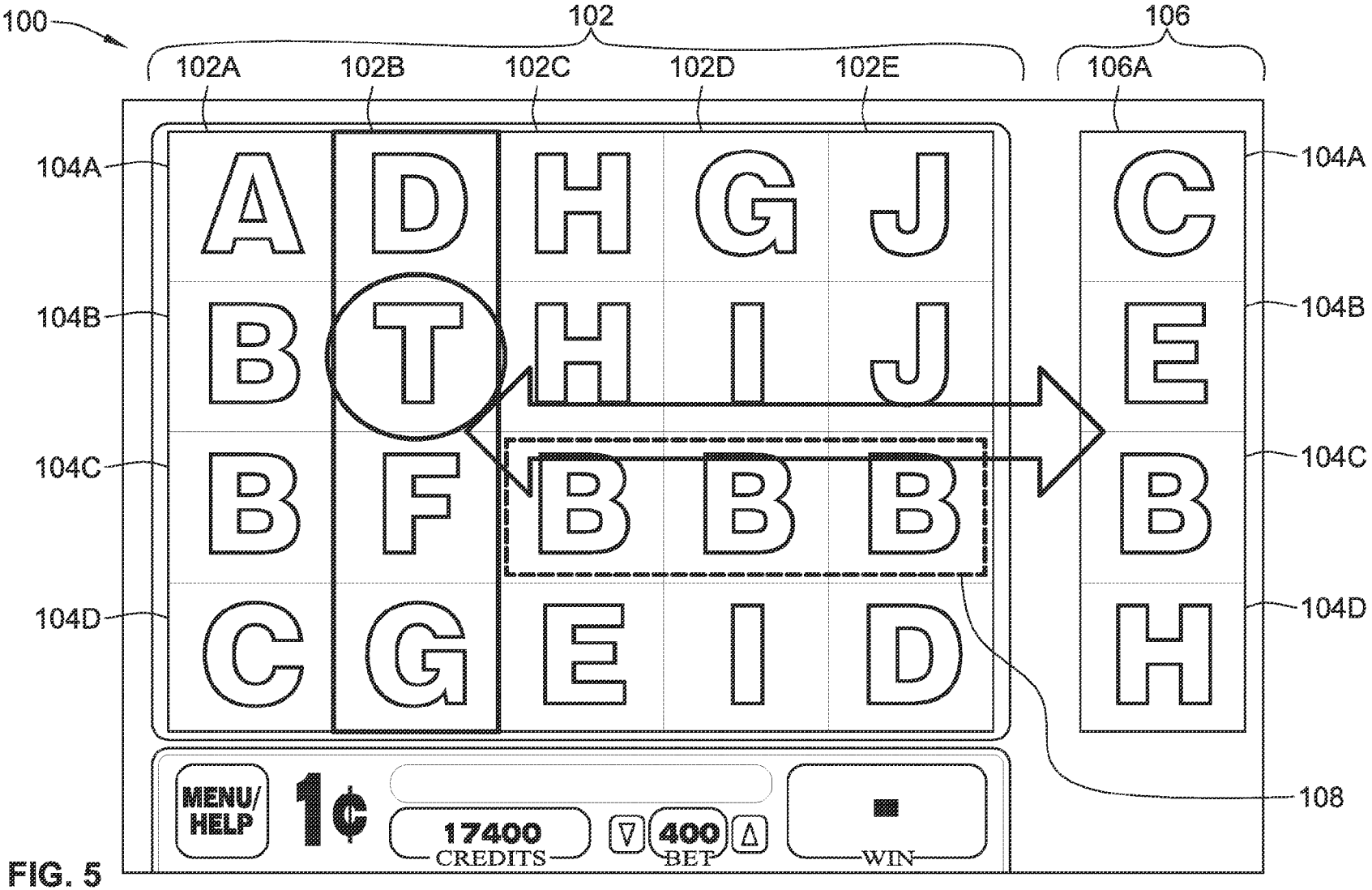
FIG. 5 illustrates an image of the wagering game of FIG. 4 in which a triggering event occurs to substitute a primary reel with the secondary reel.

Referring to FIG. 5, in one example a reel spin results in the random selection of a trigger symbol "T" that is selected and displayed in the second primary reel 102B (top-center position 104B). The selection of the trigger symbol "T" is a triggering event that causes the second primary reel 102B to be substituted (or swapped) with the secondary reel 106A. In other words, according to this embodiment, the primary reel on which the trigger symbol "T" is displayed is the reel that is substituted with the secondary reel 106A.

The primary array 102 is preferably evaluated prior to substituting the second primary reel 102B with the secondary reel 106A. The evaluation determines, for example, that no winning combinations are achieved and, as such, the initial outcome is a non-winning outcome. Alternatively, assuming that three adjacent symbols of the same kind provide an award along an active payline, a single winning combination 108 is achieved based on symbols "B"-"B"-"B" in the bottom-center positions 104C of the third, fourth, and fifth primary reels 102C-102E.

The reel spin includes the spinning of the secondary reel 106A, which includes the "C"-"E"-"B"-"H" symbols. Typically, although not necessarily, the symbols of the secondary reel 106A deem the secondary reel 106A as a more valuable reel than the primary reels 102A-102E. As such, a player is more likely inclined to wish that a swap will occur to include the secondary reel 106A instead of one of the primary reels 102A-102E that is perceived to be least valuable. For example, the "B" symbol may be a game-enhancement symbol such as a wild symbol or a multiplier symbol. The enhanced potential value of the "B" symbol deems the secondary reel 106A more valuable than, for example, the second primary reel 102B. Swapping the two reels provides the player with a modified primary array that has increased potential value, e.g., one additional wild symbol that is likely to result in additional or more valuable winning outcomes.

Thus, in this example, the primary array 102 is evaluated twice—initially, without the secondary reel 106A, and, subsequently, with the secondary reel 106A. In an alternative example, the primary array 102 is evaluated only with the secondary reel 106A substituted within the primary reel 102. Thus, in the alternative example there is no evaluation prior to substituting the secondary reel 106A with a reel of the primary array 102.

In another example, the triggering event causes the substitution of the secondary reel 106A with a randomly selected reel of the primary reels 102A-102E. Thus, instead of the second primary reel 102B in which the trigger symbol "T" was displayed, any of the primary reels 102A-102E is randomly selected to be substituted with the secondary reel 106A. Optionally, the random selection is limited to only those primary reels that are deemed to be less valuable than the secondary reel 106A. For example, if the fourth and fifth primary reels 102D, 102E are deemed to be more valuable than the secondary reel 106A, the random selection is limited to selecting one of the first three primary reels 102A-102C for substitution with the secondary reel 106A. Accordingly, this type of substitution ensures that the substitution results in a more valuable modified array than the initial array, and, thus, a more valuable modified outcome.

In yet another example, the triggering event causes the secondary reel 106A to substitute in the best location of the primary array 102. The best location is determined, for example, based on determining which winning outcome will results in the largest award. For example, if substituting the secondary reel 106A for the first primary reel 102A will result in an award of 10 credits, substituting the secondary reel 106A for the second primary reel 102B will result in an award of 100 credits, and the substituting of the secondary reel 106A for any of the last three primary reels 102C-102E will result in an award of 0 credits, the secondary reel 106A is substituted for the second primary reel 102B (resulting in the largest award of 100 credits).

Figure 6:
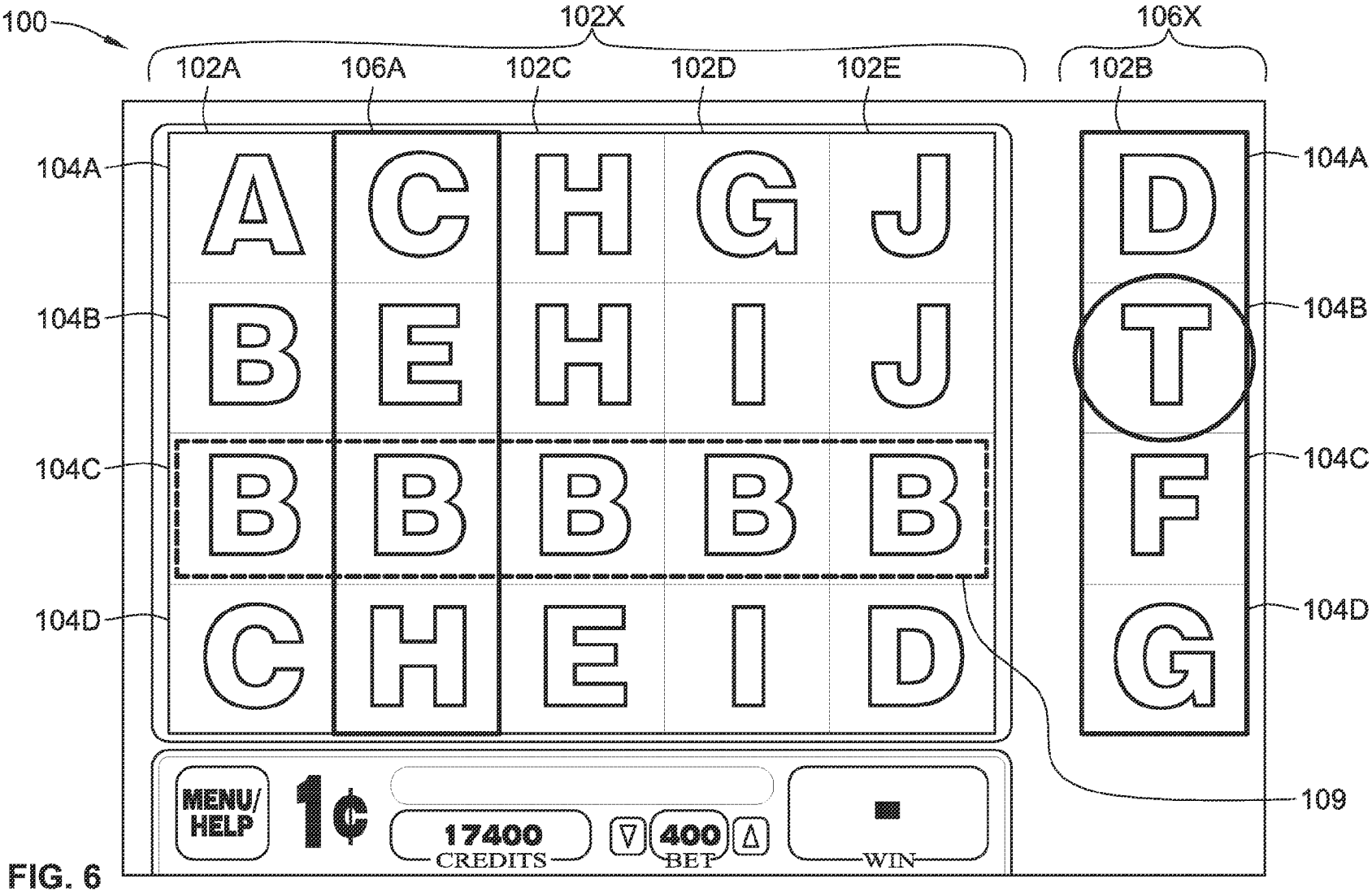
FIG. 6 illustrates an image of the wagering game of FIG. 5 illustrating the substituted reels.

Referring to FIG. 6, the substitution between the secondary reel 106A and the second primary reel 102B is now complete. The primary array 102 is now a modified primary array 102X in which the five reels include as a new second reel the secondary reel 106A between the first primary reel 102A and the third primary reel 102C. The secondary array 106 is now a modified secondary array 106X with the single secondary reel being the second primary reel 102B.

Upon evaluating the modified primary array 102X, a determination is made, for example, that a final outcome includes at least one winning combination 109 along an active payline. Specifically, the winning combination 109 includes five symbols "B" (e.g., five-of-a-kind combination) in the bottom-center position 104C of each reel of the modified primary array 102X.

Figure 7:
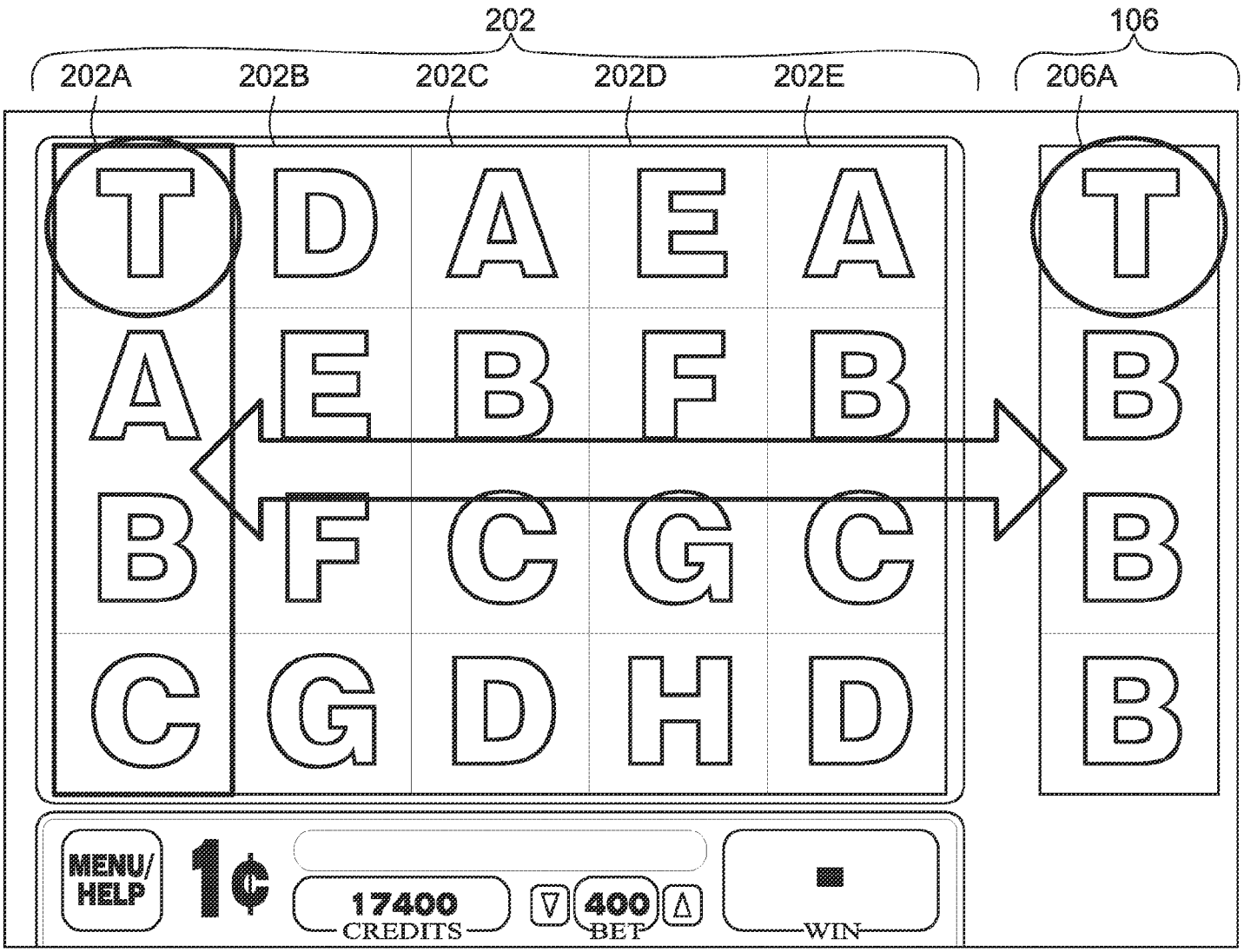
FIG. 7 illustrates a triggering event including a plurality of trigger symbols.

Referring to FIG. 7, the triggering event includes a plurality of trigger symbols. For example, a trigger symbol "T" must occur in both a primary array 202 and a secondary array 206. The two trigger symbols "T"—one occurring in a first primary reel 202A and one occurring in a top position of the secondary array 206—represent the triggering event that causes the substitution of a secondary reel 206A for one of the primary reels 202A-202E. Thus, the triggering event can include an occurrence in the primary array 202, the secondary array 202, or both.

Figure 8:
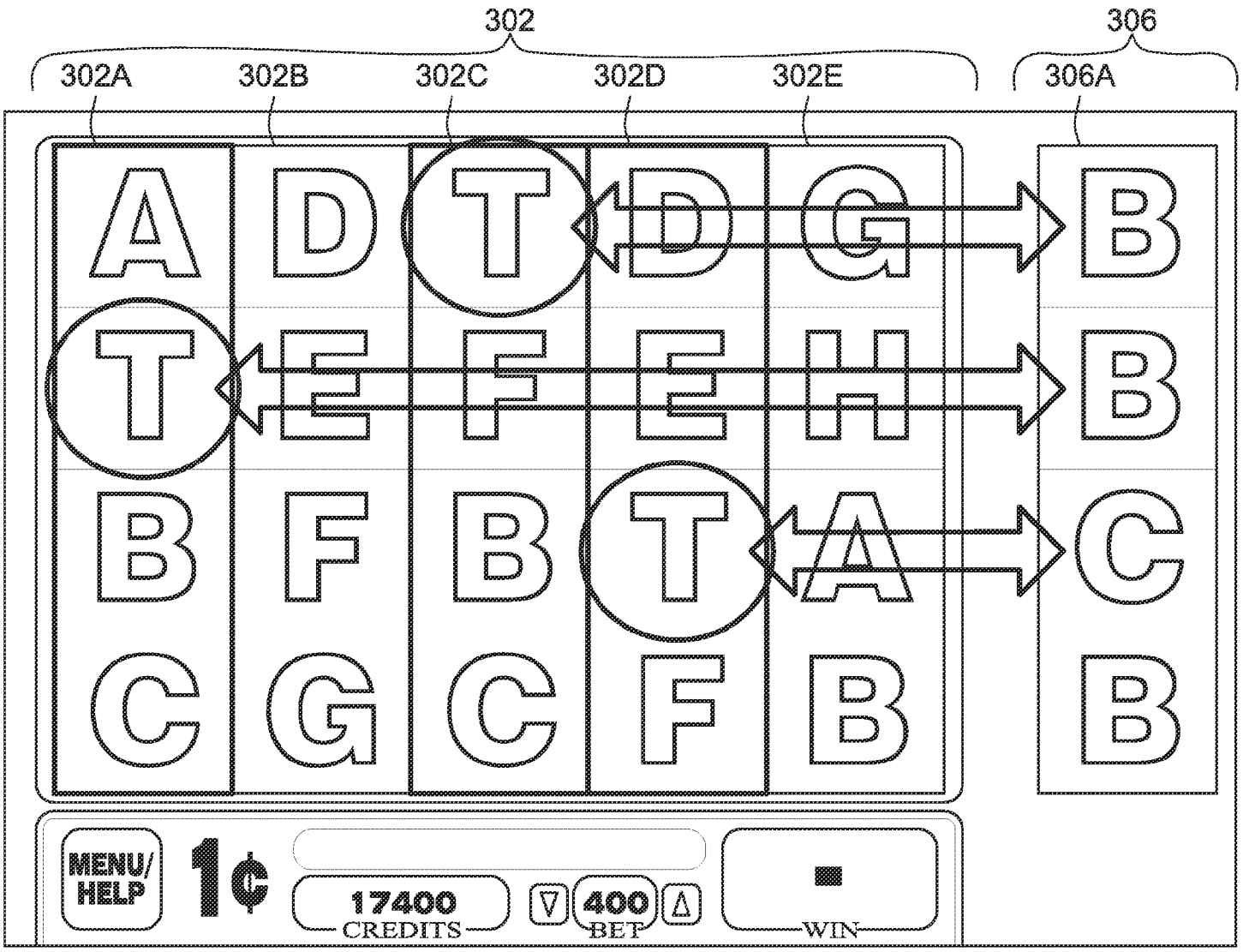
FIG. 8 illustrates a reel substitution in which a plurality of reels are substituted.
Figure 9A:
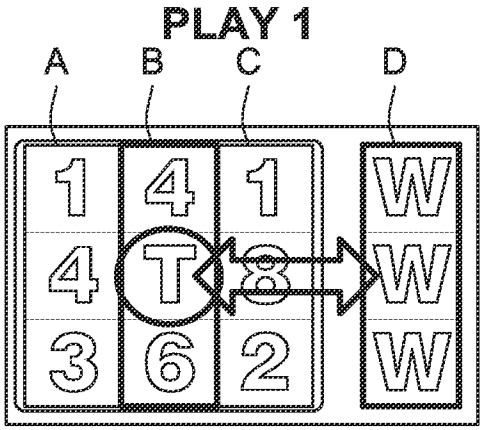
FIG. 9A illustrates a first play of plurality of plays in which a substituted reel persists in the same position until a subsequent triggering event occurs.
Figure 9B:
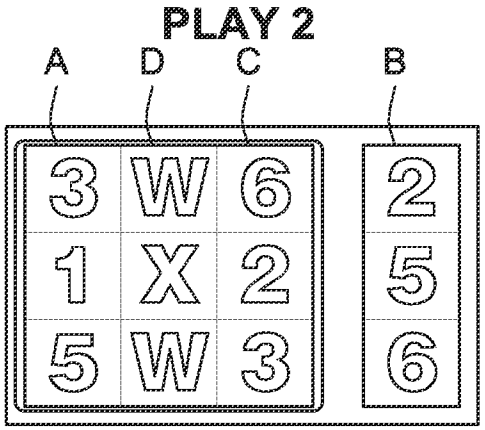
FIG. 9B illustrates a second play of the plurality of plays in which a substituted reel persists in the same position until a subsequent triggering event occurs.
Figure 9C:
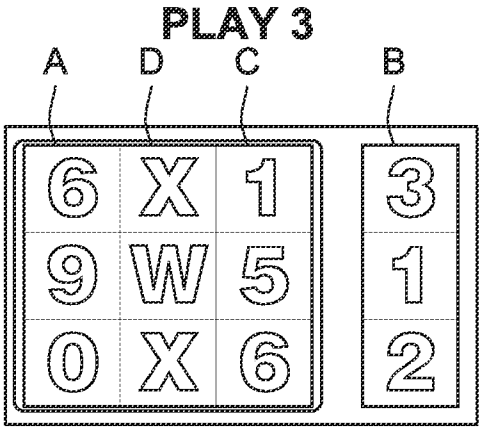
FIG. 9C illustrates a third play of the plurality of plays in which a substituted reel persists in the same position until a subsequent triggering event occurs.
Figure 9D:
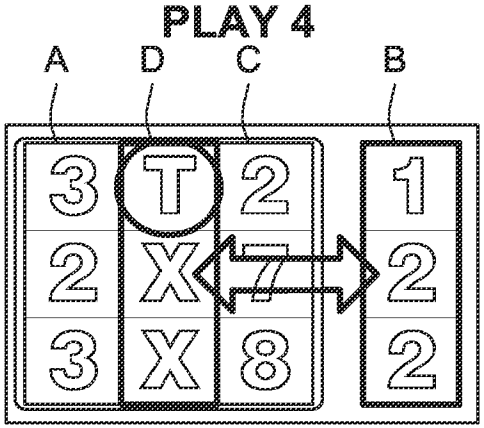
FIG. 9D illustrates a fourth play of the plurality of plays in which a substituted reel persists in the same position until a subsequent triggering event occurs.
Figure 9E:
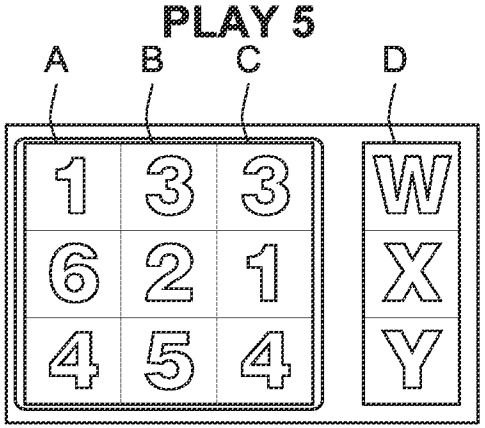
FIG. 9E illustrates a fifth play of the plurality of plays in which a substituted reel persists in the same position until a subsequent triggering event occurs.

Referring to FIG. 8, reel substitution includes in an alternative embodiment substituting a secondary reel 306A of a secondary array 306 with each reel in which a trigger symbol "T" occurs. In the illustrated example, a trigger symbol "T" occurs in a first, third, and fourth primary reels 302A, 302C, 302D, of a primary array 302. No trigger symbol "T" occurs in second and fifth primary reels 302B, 302E. Accordingly, the secondary reel 306A replaces each one of the first, third, and fourth primary reels 302A, 302C, 302D.

Referring to FIGS. 9A-9E, reel substitution optionally persists until a subsequent triggering event occurs to reset the reel substitution. In this example, a primary array consists of three primary reels—first, second, and third primary reels A-C—and a secondary array consisting of a secondary reel D. By way of example, in PLAY 1 of FIG. 9A a first triggering event occurs and is illustrated via a first trigger symbol "T" in the second primary reel B of the primary array. The second primary reel B is substituted with the secondary reel D. The second primary reel B remains in that position until a second triggering event occurs in PLAY 4 of FIG. 9D, and which is illustrated via a second trigger symbol "T" in the second primary reel D of the current modified primary array. Thus, the secondary reel D remains in the initial position of the second primary reel B for three subsequent plays—PLAYS 1-3 of FIGS. 9A-9C (which includes PLAY 1 of FIG. 9A in which the first triggering event occurs). The secondary reel D is back to its initial (standard position) as a "fourth" reel for PLAYS 4 and 5 of FIGS. 9D and 9E.

Referring to FIGS. 10A-10E, reel substitution is optionally continually evolving. In this example, a primary array consists of three primary reels—first, second, and third primary reels A-C—and a secondary array consisting of a secondary reel D. For example, in PLAY 1 of FIG. 10A a first substitution occurs between the second primary reel B and the secondary reel D, in response to a first triggering event. In PLAY 2 of FIG. 10B, in response to a second triggering event, a second substitution occurs between the third primary reel C and the second primary reel B (which is not in the position of the secondary reel D). In PLAY 3 of FIG. 10C, in response to a third triggering event, a third substitution occurs between the first primary reel A and the secondary reel D. Thus, the third substitution occurs between reels already located in the primary array. In PLAY 4 of FIG. 10D, in response to a fourth triggering event, a fourth substitution occurs in which all the reels are reset to their initial location. As such, in PLAY 4 of FIG. 10D and PLAY 5 of FIG. 10E the reels are in their original location—first, second, and third primary reels A-C are in the primary array and the secondary reel D is in the secondary array.

Figure 10A:
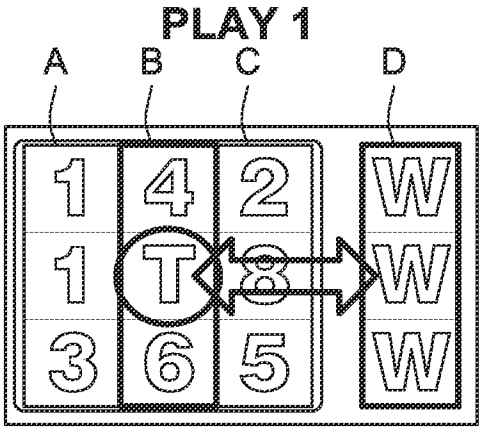
FIG. 10A illustrates a first play of a plurality of plays in which reel substitution continually evolves a primary array.
Figure 10B:
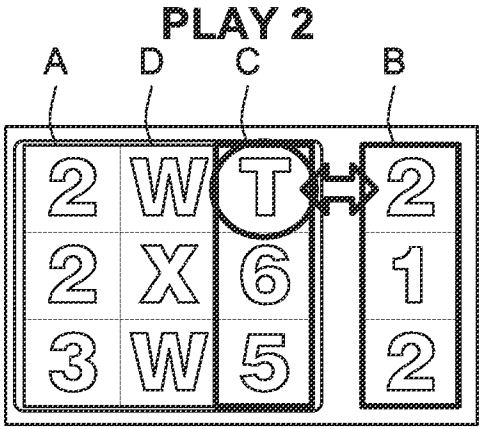
FIG. 10B illustrates a second play of the plurality of plays in which reel substitution continually evolves a primary array.
Figure 10C:
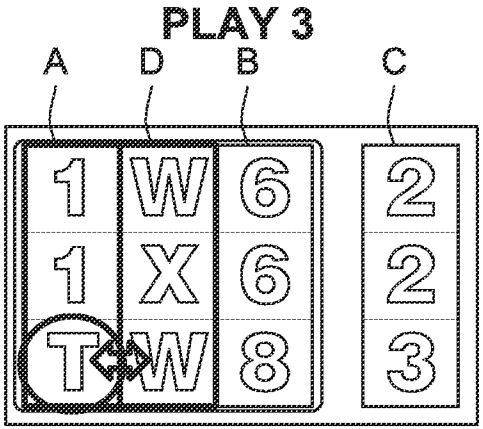
FIG. 10C illustrates a third play of the plurality of plays in which reel substitution continually evolves a primary array.
Figure 10D:
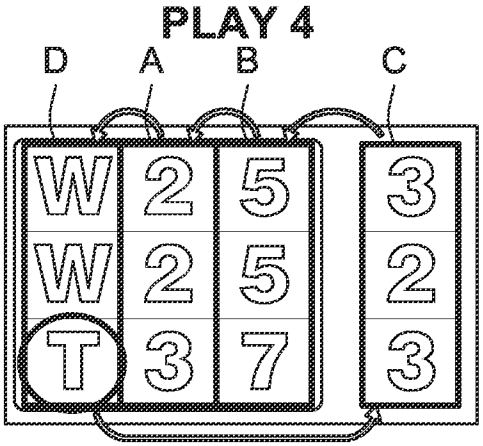
FIG. 10D illustrates a fourth play of the plurality of plays in which reel substitution continually evolves a primary array.
Figure 10E:
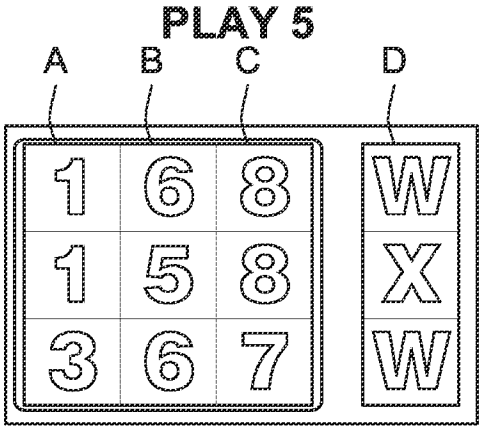
FIG. 10E illustrates a fifth play of the plurality of plays in which reel substitution continually evolves a primary array.

In the above example, PLAYS 1-5 are described as being subsequent plays (i.e., one after another). However, in other examples, the plays are not subsequent and can include intervening plays. Additionally, the resetting of PLAY 4 of FIG. 10D is optional and described only for example purposes. The evolving of the array can continue for an indeterminate number of plays. Optionally, PLAYS 1-5 are a plurality of free spins awarded in a free-spin bonus game.

The substitution of the reels is optionally determined to continually improve the potential winning outcome. For example, the reels are continually substituted to move reels on the right side of the array to the left side of the array. Assuming that reels A-D are deemed to have increasing value in the order they are presented from left to right, with the first primary reel A being deemed the least valuable and the secondary reel D being deemed to be the most valuable, the reels are continually substituted until the optimum reel is obtained—secondary reel D being in the leftmost position, third primary reel C being adjacent to the secondary reel D, and the second primary reel B being adjacent to the third primary reel C (i.e., D, C, B, and A). When this arrangement of reels occurs, the reels are optionally reset to their original position or are maintained in this arrangement for a number of subsequent plays.

Optionally, to help identify the value, or the perceived value, associated with each reel, the reels are visually identified by color or other distinguishing visual elements. For example, the most valuable reel (e.g., secondary reel D) is identified with a red color and the least valuable reel (e.g., first primary reel A) is identified with a gray color. The visual identification of the reels, based on value ranking, is likely to be helpful in motivating players to desire specific results.

In an alternative embodiment, reel substitution occurs based on order in which the reels stop. For example, referring to the arrays of FIGS. 10A-10E, the reel that stops first moves into the leftmost position of the primary array (i.e., substitutes the first primary reel A), the reel that stops second moves into the middle position of the primary array (i.e., substitutes the second primary reel B), the reel that stops third moves into the right most position of the primary array (i.e., substitutes the third primary reel C), and the reel that stops fourth moves into the position of the supplemental reel (i.e., the secondary reel D).

In another alternative embodiment, reel substitution occurs in multiple arrays. For example, referring to the arrays of FIGS. 10A-10E, at least one additional primary array is included in the wagering game. The additional primary array includes, for example, three additional primary reels E-G. The secondary reel D is optionally substituted for one more reels of each of the two primary arrays (i.e., primary reels A-C and E-G). The multiple arrays are optionally displayed simultaneously during each play.

In yet another alternative embodiment, reel substitution includes a binning feature in which reel are substituted in accordance with a wager level. For example, a wagering game includes five different wager levels 1-5, each wager level requiring an increased wager amount (e.g., 1 credit for wager level 1, 2 credits for wager level 2, etc.). If a wager amount is received that is at wager level 1, a triggered reel substitution occurs in accordance with rules associated at that wager level. By way of example, a reel substitution at wager level 2 is more favorable than a reel substitution at wager level 1. As such, a secondary reel will be substituted for a less valuable reel at wager level 2 than at wager level 1, and, accordingly, resulting in a more favorable outcome at wager level 2 than at wager level 1.

Optionally, in the binning example above, the state of the wagering game persists in accordance with each wager level. For example, the wagering game continues from the last state of the game at the respective wager level. By way of example, a player wagers at wager level 1 for 10 initial plays and, after the last play the secondary reel is in the leftmost position of the primary array. Then, the player plays a plurality of intervening plays at wager levels different than wager level 1 (e.g., 20 plays at wager level 3). After the intervening plays, the player plays 10 subsequent plays at wager level 1. When the player is playing the 10 subsequent plays, the reel positions continue from where the player had left off after playing the 10 initial plays, e.g., with the secondary reel being in the leftmost position of the primary array.

Figure 11:
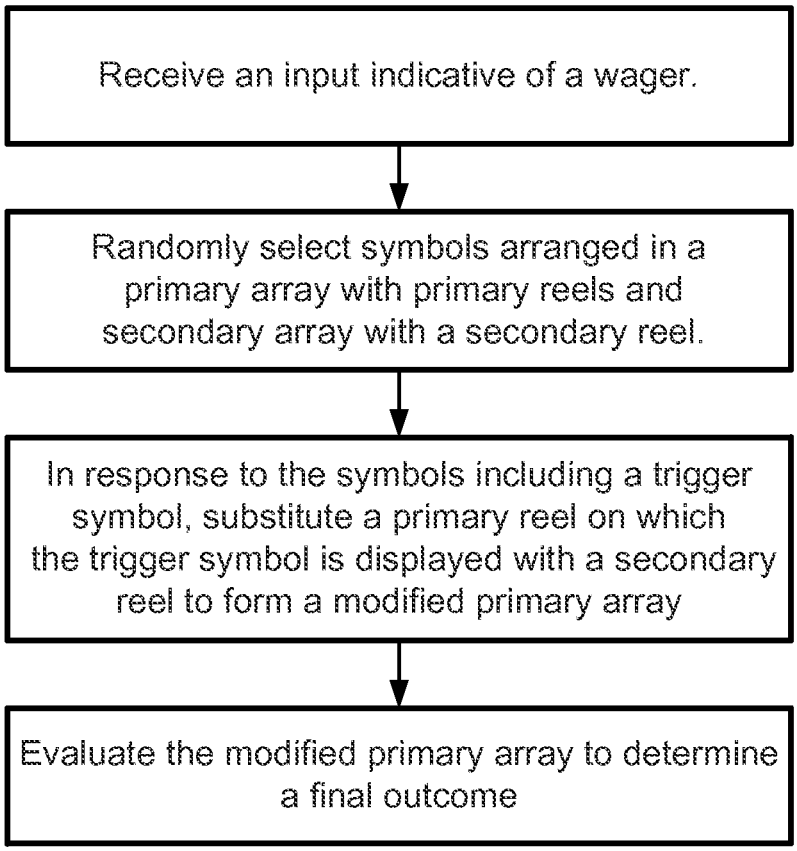
FIG. 11 is a flowchart for an algorithm that corresponds to instructions executed by a controller in accord with at least some aspects of the disclosed concepts.

FIG. 11, described by way of example above, represents one algorithm that corresponds to at least some instructions stored and executed by the game-logic circuitry 28 in FIG. 2 to perform the above described functions associated with the disclosed concepts.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system comprising:

a gaming machine primarily dedicated to playing at least one casino wagering game, the gaming machine including a gaming cabinet, an electronic display device, and an electronic input device, the cabinet constructed to house components associated with the casino wagering game, the electronic display device and the electronic input device being coupled to the gaming cabinet, the electronic input device configured to receive a physical input from a player to initiate the casino wagering game and transform the input into an electronic data signal;

a random element generator configured to generate one or more random elements; and game-logic circuitry configured to:

initiate the casino wagering game in response to the electronic data signal from the electronic input device of the gaming machine, determine an initial outcome of the casino wagering game based, at least in part, on the one or more random elements, direct the electronic display device of the gaming machine to display the initial outcome in the form of a plurality of symbols in a primary array and a secondary array, the primary array including a plurality of primary reels and the secondary array including a secondary reel, in response to the plurality of symbols including a trigger symbol, substitute one of the primary reels with the secondary reel to form a modified primary array, determine a modified outcome based on the modified primary array, and award an award in response to the initial outcome or the modified outcome meeting a predetermined award criterion.

2. The gaming system of claim 1, wherein the game-logic circuitry is further configured to direct the electronic display device of the gaming machine to display the trigger symbol on one or more of the primary reels.

3. The gaming system of claim 2, wherein the game-logic circuitry is further configured to substitute the secondary reel with at least one of the primary reels on which the trigger symbol is displayed.

4. The gaming system of claim 1, wherein the game-logic circuitry is further configured to direct the electronic display device of the gaming machine to display the secondary array adjacent to the primary array.

5. The gaming system of claim 1, wherein the game-logic circuitry is further configured to determine the initial outcome based on the primary array prior to determining the modified outcome based on the modified primary array.

6. The gaming system of claim 1, wherein the game-logic circuitry is further configured to distinguish on the electronic display device of the gaming machine the primary reels from the secondary reel.

7. The gaming system of claim 1, wherein the secondary reel includes more advantageous symbols than each of the primary reels.

8. The gaming system of claim 1, wherein the modified primary array has a higher expected value than the primary array.

9. A method of operating a gaming system, the gaming system including a random element generator, game-logic circuitry, and a gaming machine, the gaming machine primarily dedicated to playing at least one casino wagering game, the gaming machine including a gaming cabinet, an electronic display device, and an electronic input device, the cabinet constructed to house components associated with the casino wagering game, the electronic display device and the electronic input device being coupled to the gaming cabinet, the method comprising:

generating one or more random elements with the random element generator;

receiving, responsive to a physical input to the electronic input device of the gaming machine, a wager input to initiate the casino wagering game;

determining, by the game-logic circuitry, an initial outcome of the casino wagering game based, at least in part, on the one or more random elements;

displaying the initial outcome on the electronic display device of the respective gaming machine, the initial outcome being displayed in the form of a plurality of symbols in a primary array and a secondary array, the primary array including a plurality of primary reels and the secondary array including a secondary reel;

in response to the plurality of symbols including a trigger symbol, substituting one of the primary reels with the secondary reel to form a modified primary array;

determining, by the game-logic circuitry, a modified outcome based on the modified primary array; and awarding, by the game-logic circuitry, an award in response to the initial outcome or the modified outcome meeting a predetermined award criterion.

10. The method of claim 9, further comprising:

displaying, by the game-logic circuitry, the trigger symbol on one or more of the primary reels; and substituting, by the game-logic circuitry, the secondary reel with the at least one of the primary reels on which the trigger symbol is displayed.

11. The method of claim 9, further comprising determining, by the game-logic circuitry, the initial outcome based on the primary array prior to determining the modified outcome based on the modified primary array.

12. The method of claim 9, wherein the secondary reel includes more advantageous symbols than each of the primary reels.

13. The method of claim 9, wherein the modified primary array has a higher expected value than the primary array.

14. The method of claim 9, further comprising distinguishing, by the game-logic circuitry, the primary reels from the secondary reel.

15. A casino gaming machine primarily dedicated to playing at least one casino wagering game, comprising:

a gaming cabinet for housing components associated with the casino wagering game;

an electronic display device coupled to the gaming cabinet;

an electronic input device coupled to the gaming cabinet, the electronic input device configured to receive a physical input from a player to initiate the casino wagering game and transform the input into an electronic data signal; and game-logic circuitry disposed within the gaming cabinet and including a random element generator, the random element generator configured to generate one or more random elements, the game-logic circuitry configured to:

initiate the casino wagering game in response to the electronic data signal from the electronic input device, determine an initial outcome of the casino wagering game based, at least in part, on the one or more random elements, direct the electronic display device to display the initial outcome in the form of a first plurality of symbols in a primary array and a secondary array, the primary array including a plurality of primary reels and the secondary array including a secondary reel, in response to a first triggering event, substitute a first primary reel of the primary reels with the secondary reel to form a first modified primary array and a first modified secondary array, determine a first modified outcome based on the first modified primary array, direct the electronic display device to display a second plurality of symbols in the first modified primary array and the first modified secondary array reel, while maintaining the secondary reel in the first modified primary array, determine a second modified outcome based on the second plurality of symbols in the first modified primary array and the first modified secondary array, and award an award in response to any of the initial outcome, the first modified outcome, or the second modified outcome meeting a predetermined award criterion.

16. The casino gaming machine of claim 15, wherein the game-logic circuitry is further configured to:

in response to a second triggering event, substitute a reel of the first modified primary array with any other reel to form a second modified primary array; and evaluate the second modified primary array to determine a respective modified outcome.

17. The casino gaming machine of claim 16, wherein the second triggering event includes a second trigger symbol on the reel of the first modified primary array.

18. The casino gaming machine of claim 16, wherein the any other reel is another reel of the first modified primary array.

19. The casino gaming machine of claim 16, wherein the any other reel is the first primary reel.

20. The casino gaming machine of claim 16, wherein the game-logic circuitry is further configured to select the any other reel as a function of wining outcome potential.

* * * * *